US006120320A

United States Patent [19]

Veiga et al.

[11] Patent Number: 6,120,320

[45] Date of Patent: Sep. 19, 2000

[54] GFI ADAPTER

[76] Inventors: William Veiga, 5470 Lyons Rd., #207, Coconut Creek, Fla. 33073; Keith Schubert, 4 Timothy Rd., W. Norwalk, Conn. 06850

[21] Appl. No.: 09/364,022

[22] Filed: Jul. 30, 1999

Related U.S. Application Data

[60] Provisional application No. 60/094,993, Jul. 31, 1998.

[51] Int. Cl.[7] ..... H01R 13/66

[52] U.S. Cl. ..... 439/538; 361/45

[58] Field of Search ..... 439/538, 535, 439/537, 536, 221, 654, 652, 651, 105, 373, 362, 364, 365; 361/45

[56] References Cited

U.S. PATENT DOCUMENTS 4,816,957 3/1989 Irwin ..... 361/45

*Primary Examiner*—Gary F. Paumen
*Assistant Examiner*—Chi Nguyen
*Attorney, Agent, or Firm*—Gerald E. Linden

[57] ABSTRACT

GFI-protection for a wall outlet is provided by a GFI adapter which has a commercially-available type GFI wall outlet disposed within a housing. Blades extending from the screws on the GFI wall outlet plug into the slots (power, return) on the wall outlet. A shaft, accessible from the exterior of the housing, may be turned to secure the housing to the wall outlet. One or two ground pins may also be provided, to plug into the ground pin hole(s) in the wall outlet.

4 Claims, 4 Drawing Sheets

GFI ADAPTER

CROSS-REFERENCE TO RELATED APPLICATIONS

This is a continuation of commonly-owned, copending U.S. Provisional Patent Application No. 60/094,993 filed Jul. 31, 1998.

TECHNICAL FIELD OF THE INVENTION

The invention relates to household electrical wiring and, more particularly, to providing ground-fault protection at wall receptacles (outlets).

BACKGROUND OF THE INVENTION

Household wall receptacles (outlets) provide power (in the US, 120 VAC) from the power company "mains" to appliances plugged into the receptacles. Typically, new construction codes require certain receptacles, typically those which either are in a bathroom or on an exterior of a house, to be ground-fault protected. Generally, ground-fault protection involves opening a circuit when a threshold current imbalance has been detected between two legs of a circuit. The operation of ground-fault protectors is well known, and does not form a part of the present invention, per se.

Ground-fault protection can be implemented either at the circuit breaker box by providing a GFI breaker, or can be implemented at a wall receptacle location by using a GFI receptacle in lieu of a "standard" wall receptacle. For homes without ground-fault protection, or in instances where a homeowner desires to add ground-fault protection to one or more wall receptacles, either GFI breakers or GFI receptacles can be retrofitted. However, doing so requires "playing with electricity", an activity which is shunned by many homeowners.

BRIEF DESCRIPTION OF THE INVENTION

It is therefore an object of the invention to provide a technique for providing ground-fault protection at one or more receptacles (outlets).

According to the invention, a GFI module housing a GFI circuit is plugged into an existing wall outlet. The receptacle (outlet) cover (face) plate may first be removed (or may be left in place, in which case the screw securing the cover plate to the receptacle is preferably removed), the GFI module is plugged into the outlet, then the GFI is screwed into the receptacle (in the cover plate screw hole in the receptacle).

Other objects, features and advantages of the invention will become apparent in light of the following description thereof.

BRIEF DESCRIPTION OF THE DRAWINGS

Reference will now be made in detail to preferred embodiments of the invention, examples of which are illustrated in the accompanying drawings. Although the invention will be described in the context of these preferred embodiments, it should be understood that it is not intended to limit the spirit and scope of the invention to these particular embodiments.

Certain elements in selected ones of the drawings may be illustrated not-to-scale, for illustrative clarity. Often, similar elements throughout the drawings are referred to by similar reference numerals. For example, the element 199 may be similar in many respects to the element 299 in another figure. Also, often, similar elements are referred to with similar numbers in a single drawing. For example, a plurality of elements 199 may be referred to as 199*a*, 199*b*, 199*c*, etc.

DETAILED DESCRIPTION OF THE INVENTION

Figure 1:
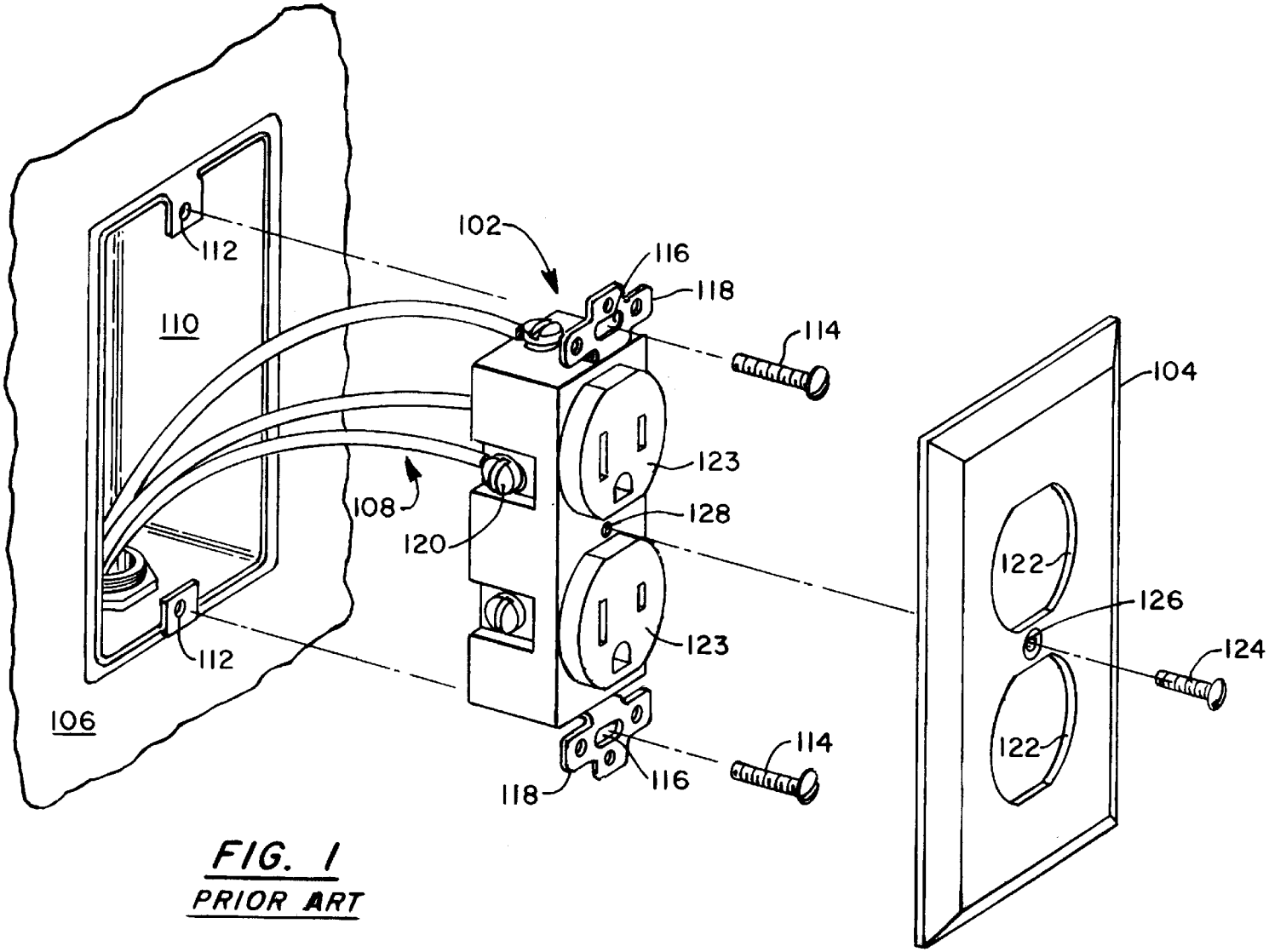
FIG. 1 PRIOR ART
FIG. 1 is an exploded perspective view of a common wall outlet and cover plate of the prior art.

FIG. 1 illustrates a typical household wall outlet (receptacle) 102 and cover plate 104 of the prior art. A wall 106 is shown, with three wires 108 (hot, return, ground) coming out of a recessed wall outlet box 110. The outlet 102 is a dual outlet for permitting two appliances (not shown) to individually be plugged into the outlet 102. Each half of the outlet 102 has two "slots" for receiving two corresponding "blades" (hot, return) of an appliance plug, and has a hole for receiving the ground pin of an appliance plug.

The outlet box 110 has two holes 112 into which two corresponding screws 114 are threaded, through two corresponding holes 116 in two respective tabs 118 on the wall outlet 102. Two of the wires 108 are connected to corresponding two screws 120 (only one visible in this view) on either side of the wall outlet 102. The third wire 108 is connected to a ground screw (not visible)of the outlet 102. As is known, some wall outlets permit the ends of the wires 108 to be stripped (the ground wire is typically not insulated and need not be stripped) and inserted into the back (not visible) of the wall outlet 102. As is known, the holes 112 in metal outlet boxes are typically threaded, and the holes 112 in plastic outlet boxes are typically threadable (by the screws). The cover plate 104 has two holes 122, each corresponding to a respective "bezel" 123 of the outlet 102, and is secured to the wall outlet 102 by a screw 124 extending through a small central hole 126 in the cover plate 104 and threaded into a corresponding hole 128 in the outlet 102.

Figure 2:
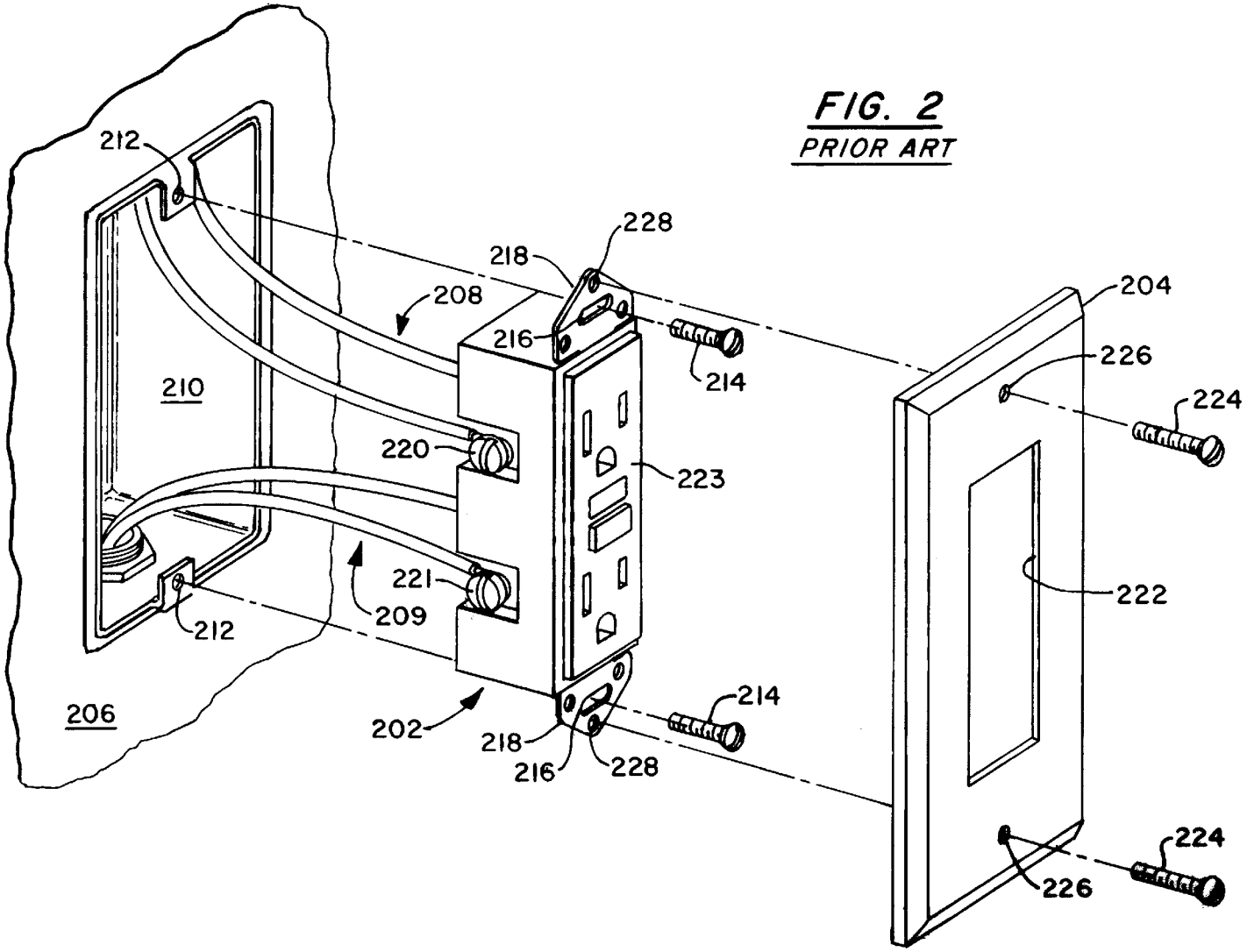
FIG. 2 PRIOR ART
FIG. 2 is an exploded perspective view of a common GFI wall outlet and cover plate of the prior art.

FIG. 2 illustrates a typical GFI-type household wall outlet 202 (compare 102) and cover plate 204 (compare 104) of the prior art. A wall 206 (compare 106) is shown, with two pairs of wires 208 and 209 coming out of a recessed wall outlet box 210 (compare 110). The outlet 202 is a dual outlet for permitting two appliances (not shown) to individually be plugged into the outlet, but typically has only one large bezel 223, as contrasted with two smaller bezels (compare 123). The outlet box 210 has two holes 212 (compare 112) into which two corresponding screws 214 (compare 114) are threaded, through two corresponding holes 216 (compare 116) in two respective tabs 218 (compare 118) on the GFI wall outlet 202. The wires 208 and 209 are connected to corresponding screws 220 and 221 (only one of each visible in this view) on either side of the GFI wall outlet 202. The cover plate 204 has one very large hole 222 (compare 122) sized and shaped to receive the bezel 223 of the outlet 202, and is secured to the outlet 202 by two screws 224 (compare 124) extending through two holes 226 (compare 126) in the cover plate 204 and threaded into two corresponding (typically threaded) holes 228 on the tabs 218 of the outlet 202.

As mentioned hereinabove, it is often dangerous for a homeowner (i.e., other than a licensed electrician) to attempt to replace a wall receptacle (e.g., 102) with a GFI wall receptacle (e.g., 202). To the end of avoiding this dangerous task, there are devices on the market which simply plug into an existing wall outlet and provide the sought after GFI protection.

Figure 3:
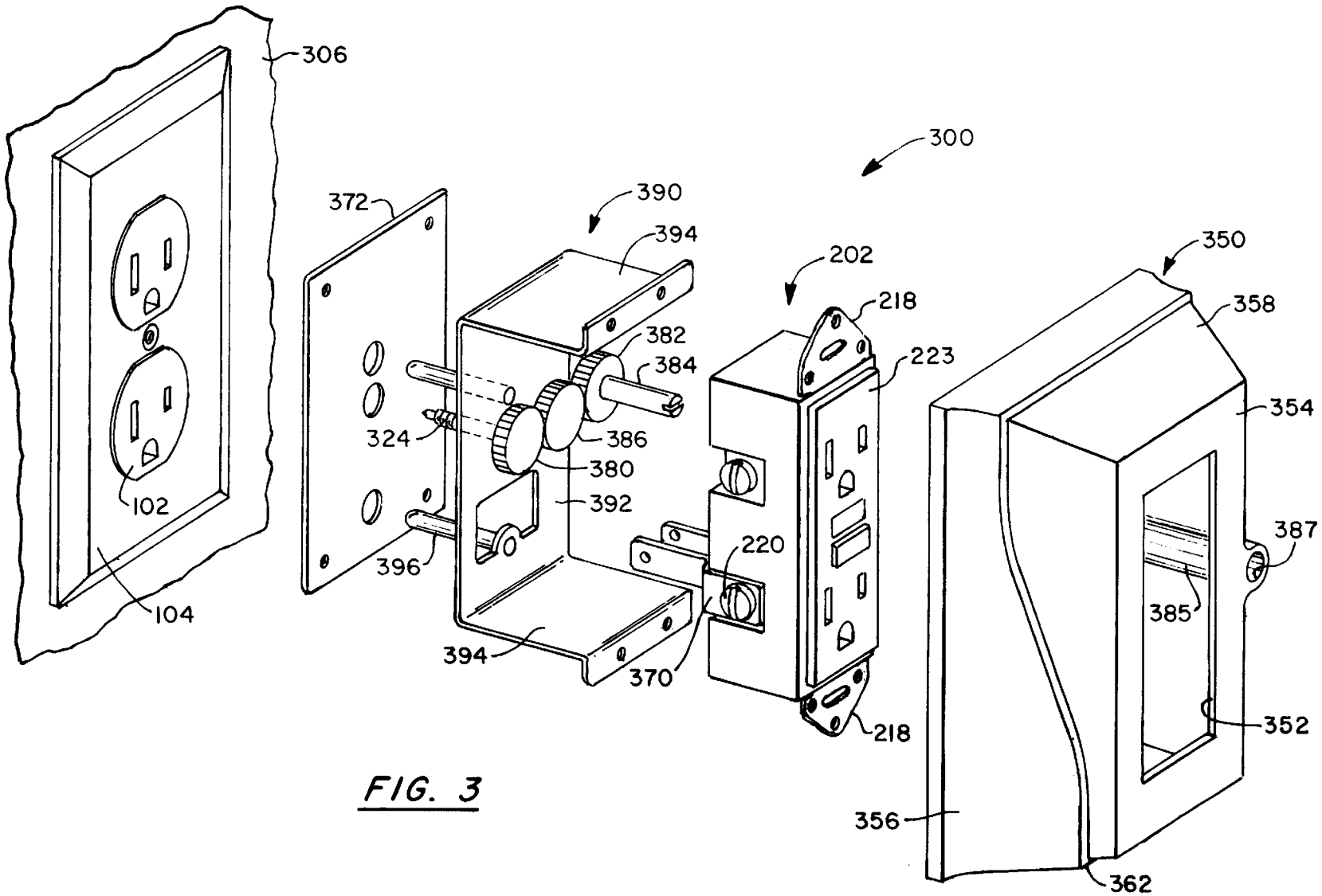
FIG. 3 is an exploded perspective view of the GFI adapter of the present invention.

FIG. 3 illustrates the GFI adapter module 300 of the present invention. The GFI adapter module 300 plugs into a conventional wall socket 102 which may have its coverplate (faceplate) 104 in place. The coverplate 04 can optionally be removed.

As is shown, the GFI adapter module of the present invention may suitably employ a "standard" GFI wall outlet 202 as one of its components. Generally, the outlet 202 is disposed within a housing 350 which has an opening 352 in a base portion 354 thereof which is sized and shaped to accommodate the bezel 223 of the outlet 202. The outlet 202 is mounted within the housing 350 in any suitable manner, such as with molded-in posts (not shown) on the interior of the base portion 354, which posts are located and sized to fit within holes on the tabs 218 of the outlet and can be ultrasonically (or with heat) "mushroomed" to retain the outlet 202 in the housing 350. Alternatively, the outlet 202 can be mounted in the housing with appropriate holes (compare 226) and screws (224) extending through the holes into corresponding holes (compare 228) in the tabs 218. The housing 350 is preferably made of plastic.

The housing 350 is a five-sided box, having a base portion 354 (described hereinabove), and four side wall 356, 358, 360 (not visible) and 362 (not visible) extending from the perimeter of the base portion 354, and is sized to completely receive the outlet 202.

Rather than attaching wires (compare 208, 209) to the outlet 202, blades 370 are provided, having one end which is clamped under a screw 220 (one visible) of the outlet 202 and another end which plugs into the outlet 102.

In this manner, without more, a GFI outlet 202 can be housed (350) and plugged into a wall outlet 102.

Preferably, the GFI adapter module 300 can be secured to the wall. To this end, a screw 324 (compare 124) is provided which can (if you can turn it!) screw into the hole (compare 128) of the wall outlet 102. Now, this screw 324 is evidently "behind" the outlet 202, making turning it a bit difficult, without more.

A mechanism is provided to enable a user to turn the screw 324 with the housing 350 in place against the wall 306 (compare 106) and the GFI outlet 202 plugged (via the blades 370) into the wall outlet 102.

Figure 3A:
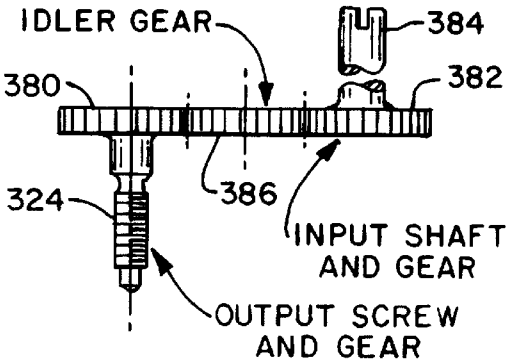
FIG. 3A is a detailed view of a portion of the GFI adapter of the present invention.

The mechanism comprises a gear 380 at an end of the screw 324. Another gear 382 is at the end of a shaft 384, a portion which is exposed and can be turned by a user. An idler gear 386 is preferably disposed between the gears 380 and 382 so that they both turn in the same direction. Preferably, the gear ratio of the "gear train" 380/382/386 is 1:1, to preserve correct "ergonomic" feel. Alteratively, the gear ratio could be higher or lower. Alteratively, a belt (not shown) could be disposed between the shaft 384 and the screw 324 to facilitate turning the screw 324 by turning the shaft 384, while preserving "directionality" and preferably with a 1:1 ratio. FIG. 3A is a detailed view of the gear train 380/382/386.

The gears 380, 382 and 386 are all disposed to rotate on a surface 392 of a bracket 390 which is disposed behind the GFI outlet 202. The screw 324 extends in one direction (towards the wall 306) from the surface 392, the shaft 384 extends in another (opposite) direction from the surface 392. The bracket 390 has two side (top and bottom) tabs ("ears") 394 which extend from the base portion 392 towards the surface 354 of the housing 350, which can be affixed along with the outlet 202 within the housing using deformable posts (as described hereinabove) , screws, and the like. The bracket 390 is preferably made of metal.

The shaft 384 is suitably disposed within an elongate boss 385 molded into the side wall 360 of the housing 350, and its distal end is formed with a slot so that it can be turned by a common screwdriver inserted into a hole 387 at the front end of the boss 385. The boss 385 may extend fully (as shown) or partially along the side wall 360. The slotted end of the shaft 384 can be recessed, and formed to require a special "installation" tool (not shown).

An insulating planar cover 372 is disposed behind the bracket 390.

Optionally, one or more ground posts 396 extend from the surface 392 of the bracket 390, and are sized and located to plug into the ground hole(s) of the wall outlet 102.

A benefit of the present invention is that GFI protection may be implemented at a wall socket without requiring the user to mess with the wiring. The GFI adapter module 300 simply plugs into the existing wall outlet 102 and screws into the hole (128) previously occupied by the faceplate-mounting screw (124) Removal of the faceplate 104 is entirely optional.

Another benefit is that few components need to be manufactured, when an off-the-shelf GFI outlet (202) is incorporated into the GFI adapter module 300. Also, since the off-the-shelf GFI outlet (202) is "approved" (passed by UL, or other regulatory authority), approval for the GFI adapter 300 is greatly facilitated.

Figure 4:
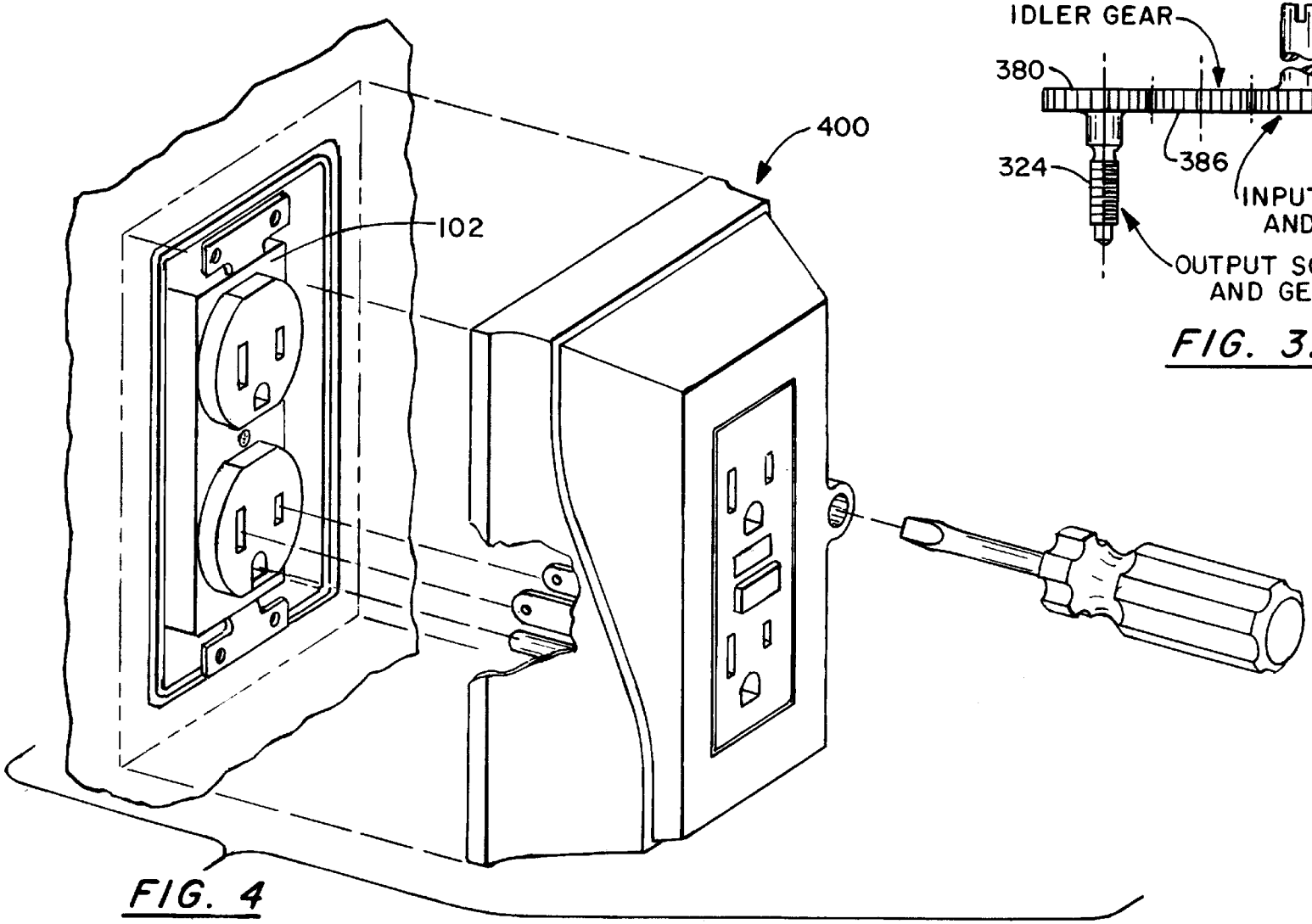
FIG. 4 is a perspective view of the GFI adapter of the present invention being installed.

FIG. 4 illustrates a GFI adapter 400 (compare 300) being mounted to a standard wall outlet 102 which has had its faceplate (104) removed.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A GFI adapter, comprising:

a housing having a base portion and four sides extending from the base portion;

a large opening in the base portion;

a bracket having for retaining a GFI outlet within the housing;

two blades, each extending from a corresponding one of two screws (hot and return) on the GFT outlet;

screw disposed on the bracket for securing the housing to a corresponding threaded hole in a wall outlet;

a shaft extending along one of the four sides and accessible from an exterior of the housing; and a mechanism, disposed within the housing, for allowing a user to turn the screw so as to secure the housing to the wall outlet.

2. The GFI adapter, according to claim 1, further comprising:

at least one pin, extending from the bracket, to be plugged into the ground hole of the wall outlet.

3. The GFI adapter, according to claim 1, wherein the mechanism comprises:

a first gear disposed on the bracket and mounted to turn when the shaft is turned; and a second gear, disposed on the bracket and mounted to turn the screw.

4. The GFI adapter, according to claim 3, further comprising:

an idler gear, disposed on the bracket, and mounted to turn the second gear in the same direction in which the first gear is turned.

* * * * *